US006807775B2

(12) United States Patent
Hoare et al.

(10) Patent No.: US 6,807,775 B2
(45) Date of Patent: Oct. 26, 2004

(54) POWER SLIDING VEHICLE DOOR

(75) Inventors: Ian Christopher Hoare, West Bloomfield, MI (US); Steven John Engelgau, Royal Oak, MI (US); Shelley Lynn Bess, Royal Oak, MI (US); Christopher Matthew Radjewski, Sterling Heights, MI (US); Joseph Allen Wilbanks, II, Hermitage, TN (US); Rajesh J. Somnay, Troy, MI (US); Silvio M. Yamada, Waterford, MI (US)

(73) Assignee: ArvinMeritor Technology, LLC, Troy, MI (US)

( * ) Notice: Subject to any disclaimer, the term of this patent is extended or adjusted under 35 U.S.C. 154(b) by 0 days.

(21) Appl. No.: 10/387,313

(22) Filed: Mar. 12, 2003

(65) Prior Publication Data

US 2004/0177560 A1 Sep. 16, 2004

(51) Int. Cl.[7] ..... E05F 11/34
(52) U.S. Cl. ..... 49/362; 474/133
(58) Field of Search ..... 49/360, 362; 296/155; 474/133, 135, 114, 115, 116, 117, 118

(56) References Cited

U.S. PATENT DOCUMENTS

| | | | | |
|---|---|---|---|---|
| 3,785,220 A | * | 1/1974 | Jacobs | 474/110 |
| 5,168,666 A | * | 12/1992 | Koura et al. | 49/360 |
| 6,247,580 B1 | * | 6/2001 | Hovst.o slashed. et al. | 198/806 |
| 6,256,930 B1 | | 7/2001 | Faubert et al. | |
| 6,283,535 B1 | | 9/2001 | Yuge | |
| 6,305,737 B1 | | 10/2001 | Corder et al. | |
| 6,385,910 B1 | | 5/2002 | Smink et al. | |
| 6,400,278 B1 | | 6/2002 | Weyerstall et al. | |
| 6,425,205 B2 | | 7/2002 | Wygle et al. | |
| 6,430,875 B1 | | 8/2002 | Clark et al. | |
| 6,435,600 B1 | * | 8/2002 | Long et al. | 296/155 |

* cited by examiner

*Primary Examiner*—Jerry Redman
(74) *Attorney, Agent, or Firm*—Carlson, Gaskey & Olds

(57) ABSTRACT

A vehicle includes an automated drive device for powered sliding movement of the door into open or closed positions. The drive device includes a belt that cooperates with a track. A biasing member urges the belt into engagement with a corresponding portion of the track to ensure adequate engagement to achieve the desired movement of the door responsive to rotary movement of the belt. In one example, the belt and track include teeth that cooperate such that rotary movement of the belt results in linear movement of the door relative to the vehicle body.

20 Claims, 2 Drawing Sheets

POWER SLIDING VEHICLE DOOR

BACKGROUND OF THE INVENTION

This invention generally relates to powered sliding vehicle doors. More particularly, this invention relates to a toothed belt drive device that provides automated movement of a vehicle sliding door.

Conventionally vehicles have included hinged doors and sliding doors to provide access to a vehicle interior. Vehicle doors had been manually operated for many years. More recently, powered moving door arrangements have been proposed and implemented. A variety of configurations are known.

One difficulty associated with a powered arrangement for moving a sliding door is that the tolerances between the vehicle body, the vehicle door and the hardware used to mount the automated moving device can make it difficult to maintain an accurate alignment of the necessary parts to achieve reliable and smooth door movement. At the same time, suppliers to vehicle manufacturers are constantly striving to minimize costs, which tends to place limitations on the potential designs.

There is a need for an improved arrangement for moving a sliding vehicle door. This invention addresses that need while avoiding shortcomings and drawbacks associated with prior attempts.

SUMMARY OF THE INVENTION

In general terms, this invention is a device for automatically moving a sliding vehicle door that biases a moving belt into engagement with a cooperating track such that rotary movement of the belt results in a linear, sliding movement of the vehicle door in a desired direction.

One vehicle door assembly designed according to this invention includes a door that is selectively moveable relative to a corresponding opening in the vehicle body. A track is supported on the door or a portion of the vehicle body near the opening that is closed when the door is in the closed position. A belt cooperates with the track such that rotary movement of the belt causes linear movement of the door relative to the opening. The belt is supported on the door when the track is supported on the vehicle body near the opening. The belt is supported on the vehicle near the opening when the track is supported on the door. A biasing member biases the belt into engagement with a corresponding portion of the track.

In one example, the belt and track have corresponding teeth that are cooperatively engaged with each other such that rotary movement of the belt results in relative linear movement between the track and the belt.

In one particular example, the belt follows a loop around a drive wheel member and a passive wheel member. A motor controls movement of the drive wheel member, which controls movement of the belt around the loop. The biasing member in such an example biases the portion of the belt associated with the passive wheel member into engagement with a corresponding portion of the track.

In one example, the biasing member provides a rotary biasing force, which pivots the belt arrangement about the axis of rotation of the drive wheel member. In another example, a brace member supports the passive wheel member such that it remains spaced apart from the drive wheel. The brace member is supported to be pivoted about a selected pivot axis so that the biasing member urges the brace member and the passive wheel member in a direction that causes the portion of the belt associated with the passive wheel member to engage a corresponding portion of the track.

The various features and advantages of this invention will become apparent to those skilled in the art from the following detailed description. The drawings that accompany the detailed description can be briefly described as follows.

DETAILED DESCRIPTION

Figure 1:
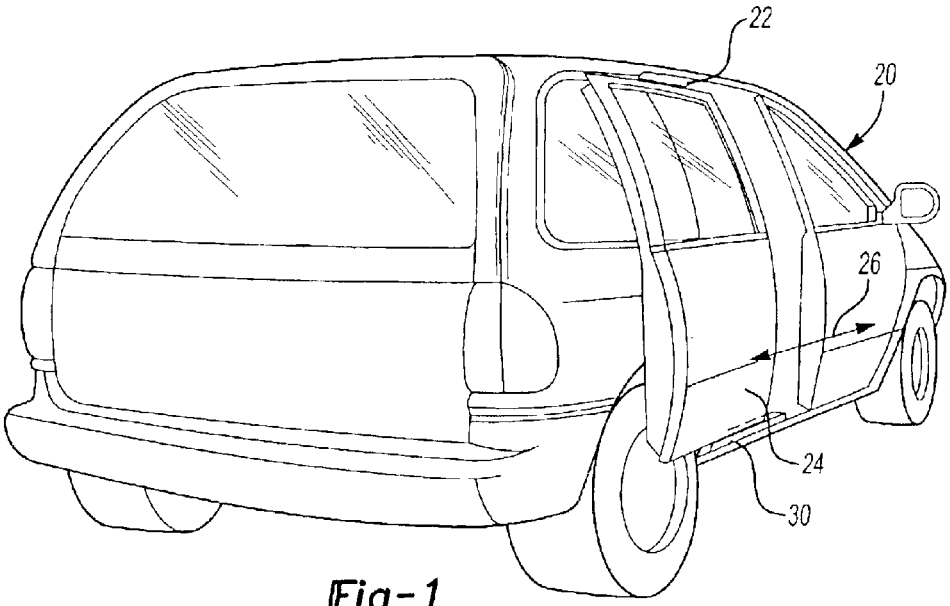
FIG. 1 schematically illustrates a vehicle having a sliding door that is automatically moved using a drive device designed according to this invention.

FIG. 1 shows a vehicle 20 that has an opening 22 that is selectively closed off by a sliding door 24. When an individual desires to enter or leave the vehicle interior, for example, the sliding door 24 is moveable as shown by the arrows 26 into an open or closed position as desired. The door 24 is supported for sliding movement in a conventional manner to support the weight of the door and to permit the door to be opened or closed as desired.

An automated drive device 30 automatically moves the door 24 according to the arrows 26 to slide the door between open and closed positions as desired. Activation of the drive device is achieved in a known manner, such as responsive to activation of a switch on a key fob or a switch in the vehicle interior that provides a signal to a controller 31 that causes operation of the drive device 30 to achieve the desired movement of the door 24.

Figure 2:
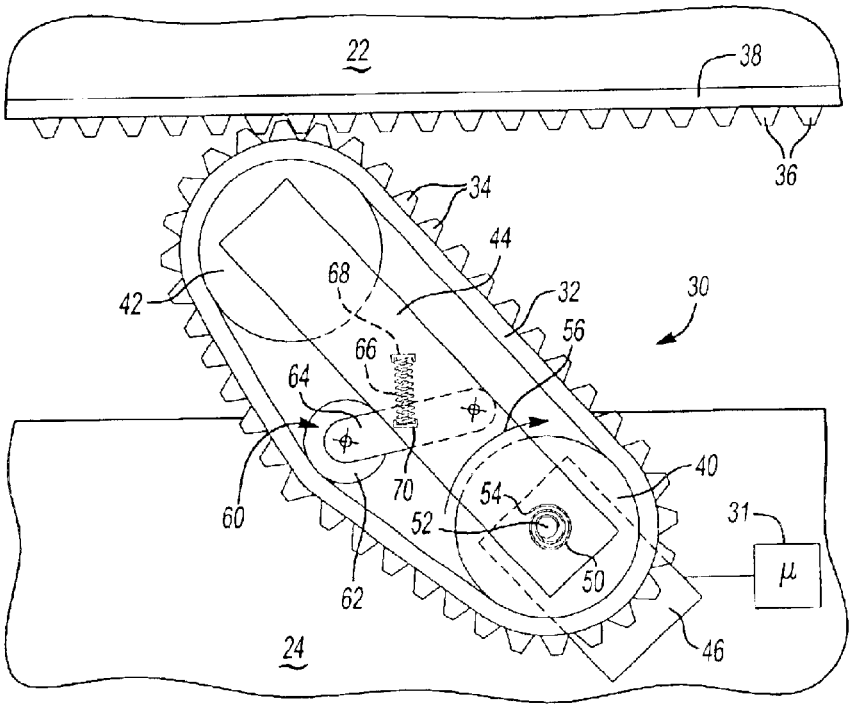
FIG. 2 schematically illustrates an example drive device designed according to this invention.

Referring to FIG. 2, the drive device 30 includes a belt 32 that has an outward configuration that is capable of achieving driving engagement with another surface. In the illustrated example, the belt 32 has a plurality of teeth 34 spaced about the outer periphery of the belt 32.

A corresponding plurality of teeth 36 are provided on a track 38 that interacts with the belt 32. The teeth 34 cooperate with the teeth 36 such that rotary movement of the belt 32 (i.e., around a loop) results in linear movement of the door 24 relative to the opening 22 in the vehicle body. In other words, rotary movement of the belt 32 results in relative linear movement between the belt 32 and the track 38.

The device 30 includes a drive wheel member 40, such as a pulley or sheave and a passive wheel member 42 each of which is at an opposite end of the loop of the belt 32. A brace member 44 supports the passive wheel member 42 and keeps the wheel members 40 and 42 a desired distance apart from each other. A drive machine 46, which includes a motor, operates responsive to control signals from the controller 31 to cause rotation of the drive wheel member 40, which causes the belt 32 to rotate about the loop established by the drive wheel member 40 and the passive wheel member 42.

The drive device 30 includes a biasing member 50 that biases the belt 32 into engagement with the track 38. In the example of FIG. 2, the biasing member 50 comprises a spring that is wound and has one end fixed to a shaft 52 that is aligned with an axis of rotation of the drive wheel member 40. An opposite end of the coil is secured to a corresponding portion 54 on the brace member 44. The coiled spring operates to urge the brace member 44 in a clockwise (according to the drawing) direction as shown by the arrow 56. Such rotary bias causes the portion of the belt 32 associated with the passive wheel member 42 to be urged into engagement with the track 38.

The biasing member 50 provides a resilient engagement between the belt 32 and the track 38. The spring constant of the coil spring in the example of FIG. 2 preferably is chosen to provide a sufficiently strong biasing force to maintain a desired level of engagement between the belt 32 and the track 38. Those skilled in the art who have the benefit of this description and know the particulars of a given vehicle will be able to select appropriate spring arrangements to achieve the desired level of engagement for their particular situation.

In the example of FIG. 2, the belt 32, the drive machine 46 and the drive wheel member 40 are all supported on the door 24 such that the belt 32 rotates about the loop relative to the door 24 but moves linearly with the door as the belt 32 cooperates with the track 38. In this example, the track 38 is supported in a stationary position on a suitable portion of the vehicle body in the vicinity of the opening 22 that is selectively closed by the door 24. In another example, the belt 32, drive machine 46 and drive wheel member 40 are all supported on the vehicle body while the track 38 is supported on the door.

The example arrangement of FIG. 2 also includes a tension member 60 that maintains a desired level of tension on the belt 32 so that there is sufficient traction between the belt 32 and the drive wheel member 40 for moving the door 24. In this example, a tension wheel 62 is supported on a lever member 64, which is supported on the brace member 44. The wheel 62 preferably is rotatably supported by the lever member 64 so that the wheel 62 engages an inner surface of the belt 32 and applies a tension force on the belt to maintain a desired level of tension in the belt during system operation.

In the illustrated example, the lever member 64 is pivotably supported on the brace member 44. A biasing member 66 engages a surface 68 on the brace member 44 at one end and a surface 70 on the lever member 64 at the other end. The bias of the biasing member 66, which in this example is a spring, urges the wheel 62 into engagement with the inner surface of the belt 32. Having a biased tension member 60 such as the wheel 62 supported on the pivotable lever member 64 accommodates changes in the effective length of the belt 32, which may be caused by changes in temperature or wear in the belt over time, for example.

Figure 3:
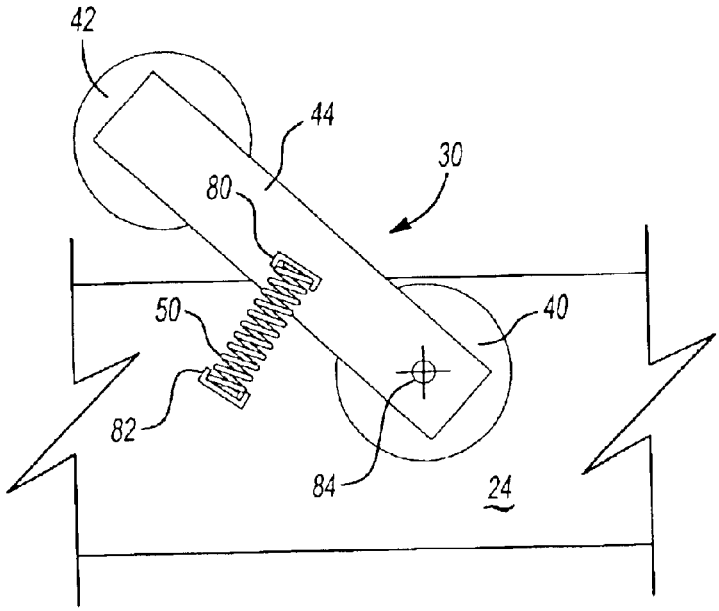
FIG. 3 schematically illustrates selected portions of an embodiment similar to that of FIG. 2 with a different biasing member.

FIG. 3 schematically illustrates selected portions of another drive device 30 designed according to this invention. In this example, the brace member 44 includes a support surface 80. A corresponding support surface 82 is on the door 24 or the vehicle body, depending on the particular arrangement. The biasing member 50 in this example comprises a spring that urges the surfaces 80 and 82 apart from each other. In this example, the brace member 44 is pivoted about an axis 84 that corresponds to the axis of rotation of the drive wheel member 40. Such an arrangement takes advantage of a situation where the drive wheel member 40 is supported to rotate about a fixed axis relative to the door or portion of the vehicle body where the belt and associated components are supported.

Figure 4:
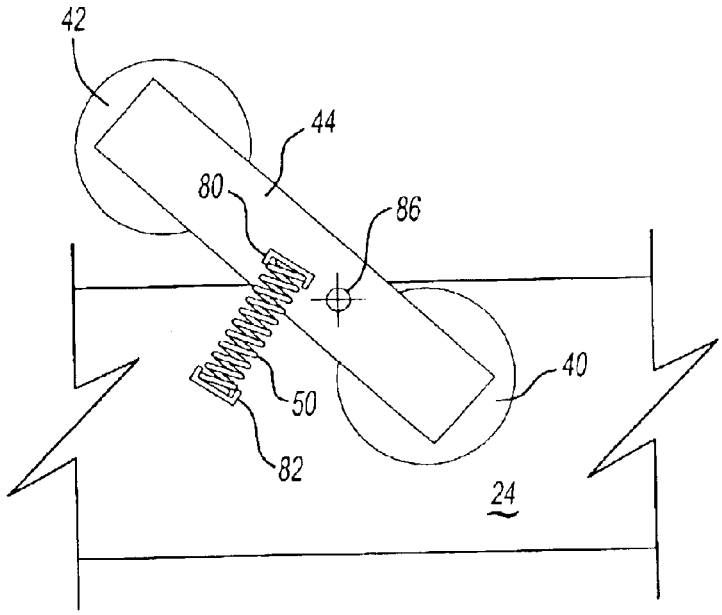
FIG. 4 schematically illustrates another embodiment that is modified compared to that of FIG. 3.

Another example is shown in FIG. 4 where a pivot axis 86 of the brace member 44 is not aligned with the rotation axis of the drive wheel member 40. This type of arrangement allows for the drive wheel member 40 to be moveable relative to the door or vehicle body portion upon which the belt and associated components are supported. In this example, the biasing member 50 comprises a spring that again urges the surfaces 80 and 82 apart from each other, which urges the brace member in. a generally clockwise (according to the illustration) direction about the pivot axis 86.

By providing a bias that causes engagement of the belt 32 with the track 38, the inventive arrangement accommodates for changes or variations along the length of travel of the sliding door relative to the vehicle body in spacing between the door structure and the vehicle body structure. Further, the inventive arrangement accommodates other variances in tolerance or component sizes in the structure used to mount the inventive drive device relative to the selected portion of the vehicle. Further still, the arrangement of this invention provides for a desired level of engagement between a drive belt and a cooperating track that remains generally consistent over the lifetime of the device.

The preceding description is exemplary rather than limiting in nature. The various embodiments that have been described provide example implementations of this invention. Those skilled in the art who have the benefit of this description may realize that variations and modifications are possible that do not necessarily depart from the scope of this invention. The scope of legal protection given to this invention can only be determined by studying the following claims.

We claim:

1. A sliding vehicle door assembly, comprising:

a door;

a track that is supported on one of the door or a portion of a vehicle body near an opening that is selectively closed when the door is in a closed position;

a belt that has a surface that cooperates with the track such that rotary movement of the belt causes linear movement of the door relative to the opening, the belt being supported on the other of the door or the vehicle body portion; and a biasing member that biases the belt into engagement with a corresponding portion of the track.

2. The assembly of claim 1, including a motor, at least one drive wheel member that is selectively rotated by the motor and at least one passive wheel member spaced from the drive wheel member, the belt rotating around corresponding portions of the wheel members responsive to rotation of the drive wheel member.

3. The assembly of claim 2, wherein the biasing member provides a rotary bias about an axis of rotation of the drive wheel member and a portion of the belt associated with the passive wheel member engages the track.

4. The assembly of claim 2, including a brace member that supports the passive wheel member near an end of the brace member and wherein the brace member is biased by the biasing member such that the portion of the belt associated with the passive wheel member engages the track.

5. The assembly of claim 4, wherein a biasing force applied by the biasing member operates to pivot the brace member such that the belt engages the track.

6. The assembly of claim 4, including a tension member supported by the brace member, the tension member engaging an inside of the belt to maintain a desired amount of tension on the belt.

7. The assembly of claim 6, wherein the tension member includes a wheel that engages the inside of the belt and rotates with movement of the belt.

8. The assembly of claim 6, including a second biasing member that biases the tension member away from the brace member.

9. The assembly of claim 1, wherein the biasing member comprises a spring.

10. The assembly of claim 1, wherein the track is supported on the door and the track moves with the door responsive to rotary movement of the belt.

11. The assembly of claim 1, wherein the belt is supported on the door for rotary movement relative to the door and for linear movement with the door.

12. The assembly of claim 1, wherein the track and the surface of the belt include teeth that cooperate to convert rotary movement of the belt into linear door movement.

13. A drive assembly for a vehicle door, comprising:

a drive machine;

at least one drive wheel member that is selectively rotated by the drive machine;

at least one passive wheel member spaced from the drive wheel member;

a toothed belt that forms a loop around the drive wheel member and the passive wheel member, the toothed belt moving around the loop responsive to rotation of the drive wheel member;

a toothed track that cooperates with the toothed belt to convert rotary movement of the toothed belt into linear movement of the toothed track; and a biasing member that biases the toothed belt into engagement with a corresponding portion of the toothed track.

14. The assembly of claim 13, wherein the biasing member provides a rotary bias about an axis of rotation of the drive wheel member and a portion of the toothed belt associated with the passive wheel member engages the toothed track.

15. The assembly of claim 13, wherein the biasing member comprises a spring.

16. The assembly of claim 13, including a brace member rotatably supporting the passive wheel member near an end of the brace member and wherein the brace member is biased by the biasing member such that the portion of the toothed belt associated with the passive wheel member engages the toothed track.

17. The assembly of claim 16, wherein the biasing force applied by the biasing member operates to pivot the brace member such that the toothed belt engages the toothed track.

18. The assembly of claim 16, including a tension member engaging an inside belt to maintain a desired amount of tension on the toothed belt.

19. The assembly of claim 18, wherein the tension member includes a wheel that engages the inside of the toothed belt and rotates with movement of the toothed belt.

20. The assembly of claim 18, wherein the tension member is associated with the brace member and including a second biasing member that biases the tension member away from the brace member.

* * * * *

UNITED STATES PATENT AND TRADEMARK OFFICE

CERTIFICATE OF CORRECTION

PATENT NO. : 6,807,775 B2
DATED : October 26, 2004
INVENTOR(S) : Hoare et al.

It is certified that error appears in the above-identified patent and that said Letters Patent is hereby corrected as shown below:

Column 6,
Line 20, please insert -- of the toothed -- after “inside” and before “belt”.

Signed and Sealed this

First Day of February, 2005

JON W. DUDAS
*Director of the United States Patent and Trademark Office*